US005183962A

United States Patent [19]

Karius et al.

[11] Patent Number: 5,183,962

[45] Date of Patent: Feb. 2, 1993

[54] SUBMUNITION FOR A SPIN STABILIZED CARRIER PROJECTILE

[75] Inventors: Klaus D. Karius, Jüchen; Armin Eskam, Langenfeld; Karl-Heinz Vogt, Essen, all of Fed. Rep. of Germany

[73] Assignee: Rheinmetall GmbH, Düsseldorf, Fed. Rep. of Germany

[21] Appl. No.: 884,141

[22] Filed: May 18, 1992

[30] Foreign Application Priority Data

May 17, 1991 [DE] Fed. Rep. of Germany ..... 4116191

[51] Int. Cl.[5] ..... F42B 12/58

[52] U.S. Cl. ..... 102/489; 102/293; 102/357; 102/377

[58] Field of Search ..... 102/246, 293, 340, 342, 102/351, 357, 377, 393, 476, 489

[56] References Cited

U.S. PATENT DOCUMENTS 1,309,982 7/1919 Darling ..... 102/340

2,721,517 10/1955 Workman ..... 102/377

4,557,198 12/1985 Hickey ..... 102/489

FOREIGN PATENT DOCUMENTS

87/11921 2/1989 Fed. Rep. of Germany .

*Primary Examiner*—Harold J. Tudor

*Attorney, Agent, or Firm*—Spencer, Frank & Schneider

[57] ABSTRACT

A submunition unit for a spin stabilized carrier projectile (1), with the submunition unit including an antenna disposed at the nose of its casing (7), and with the antenna (5) being covered by a protective cover (6). The casing (7) and the protective cover (6) are provided with respective axially overlapping collars (8, 9) which are each provided with respective opposed circumferential grooves (14, 15) to form an annular recess to accommodate an elastic securing ring (16). The securing ring, which is normally positioned within the innermost of the circumferential grooves, expands under the influence of centrifugal forces to connect the casing and protective cover together in a form-locking manner.

11 Claims, 2 Drawing Sheets

FIG.1
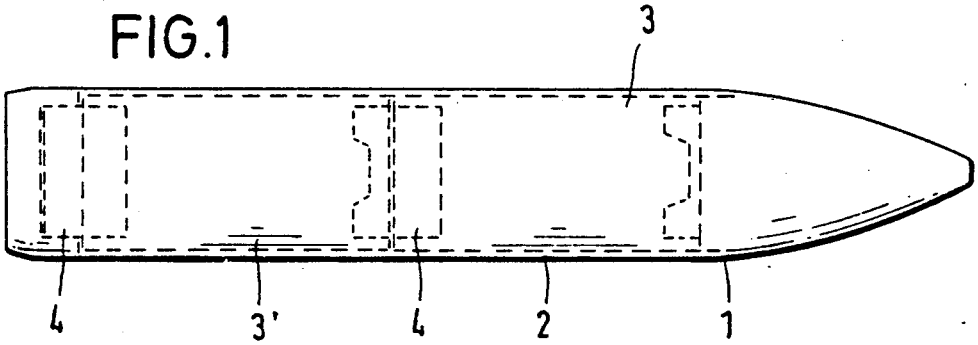
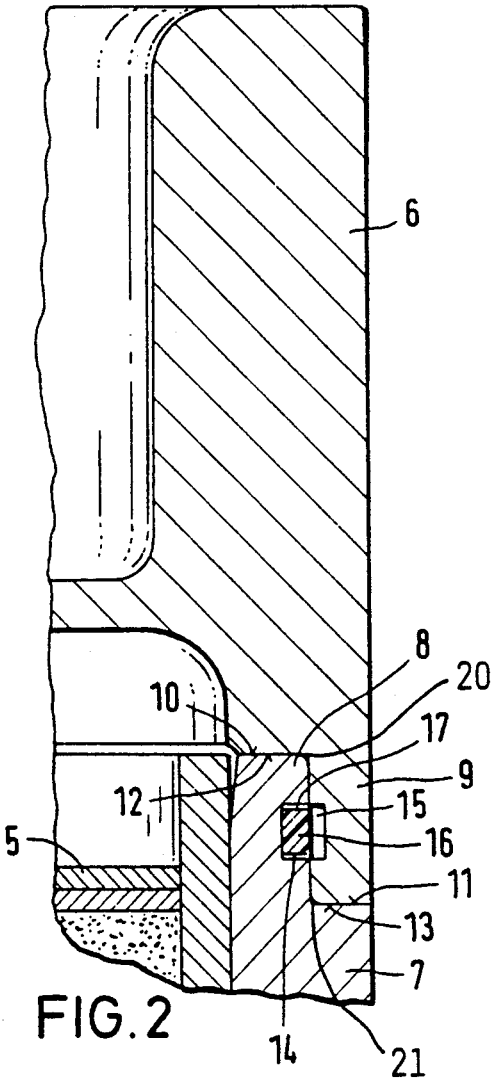
FIG.2
FIG.3
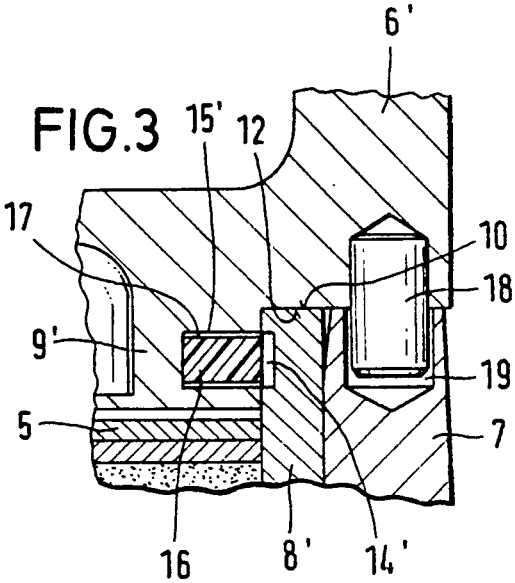
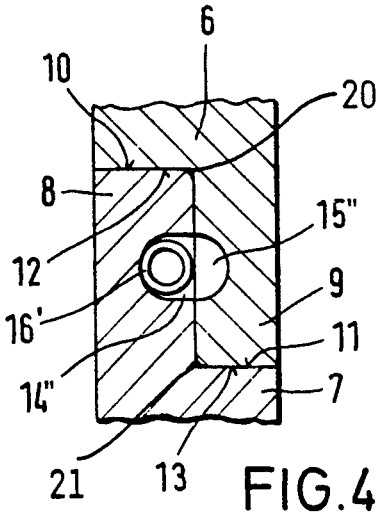
FIG.4

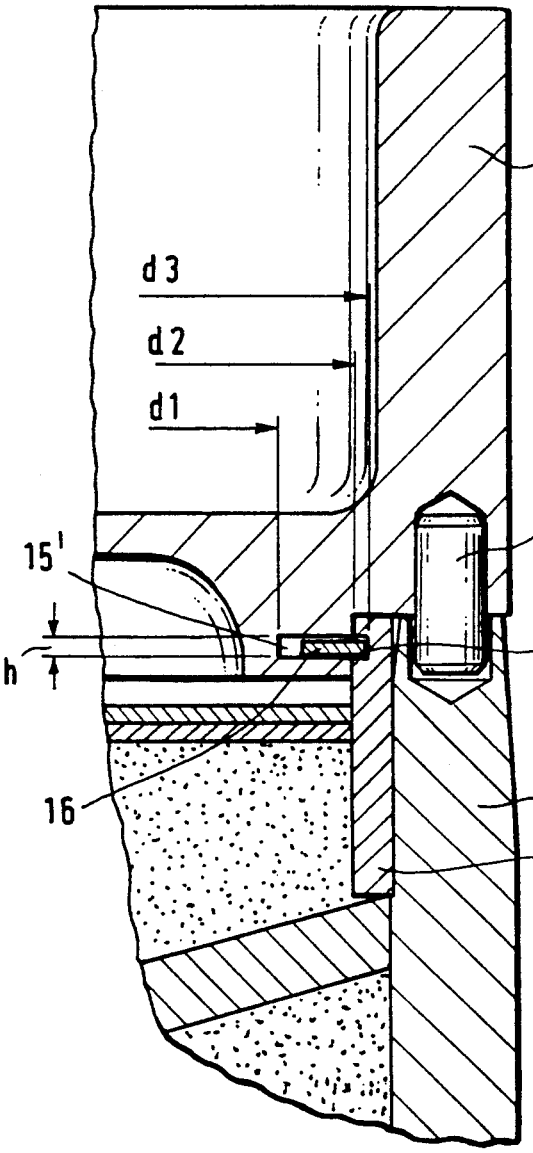
FIG.5
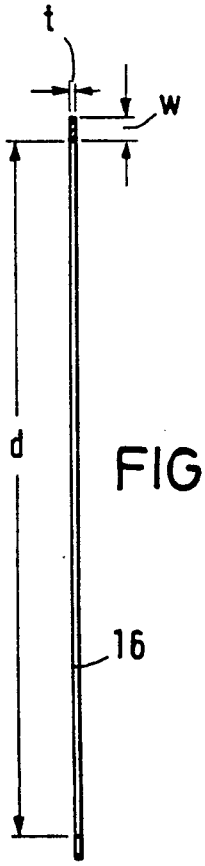
FIG.6a
FIG.6
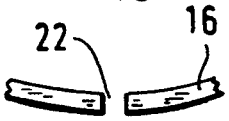

SUBMUNITION FOR A SPIN STABILIZED CARRIER PROJECTILE

BACKGROUND OF THE INVENTION

The present invention relates to a submunition unit for a spin stabilized carrier projectile. More particularly, the present invention relates to an improved submunition unit for a spin stabilized carrier projectile, wherein the submunition unit is of the type having an antenna at the nose of its casing, with the antenna being protected by a protective cover that is in engagement with the casing via axially overlapping collars that are supported against one another via radial end surfaces; and wherein the protective cover is secured to the casing by a locking element which, under the influence of an appropriate centrifugal force, is movable in the direction toward the casing circumference to form a form-locking connection between the casing and the protective cover, with the locking element releasing the protective cover from the casing when the number of revolutions, and thus the centrifugal force, drops below a certain value.

A submunition unit of the above type is disclosed in German Utility Model Patent 87/11,921 in which the casing of the submunition unit is provided with a plurality of axial holding pins which, outside of the casing, are provided with a circumferential groove. The protective cover is provided with blind bores arranged to correspond to the holding pins and each associated with a respective plunger resiliently supported in a respective sleeve or bushing, so that under the appropriate centrifugal force, the radially outwardly oriented ends of the plungers engage in the adjacent groove of a holding pin so as to secure the protective cover to the casing. The protective cover, which protects the antenna of the submunition unit against the parachute of a submunition unit adjacent to it within the same carrier projectile, is released only if, after release of the submunition unit from the carrier projectile, the number of revolutions of the submunition unit has dropped below a certain value under the influence of a deceleration parachute and can thus be separated from the descending submunition unit by opening of its main parachute. Such a structure requires many individual parts having very high tolerance requirements during manufacture and working, and is therefore expensive. Moreover, mechanical overloads during the ejection and separating phase as well as a reliable seal of the protective cover during the firing phase may pose problems.

SUMMARY OF THE INVENTION

It is therefore an object of the present invention to provide a submunition unit of the above discussed general type which is simplified with respect to its structure and manufacture, requires low tolerances and ensures reliable and problem free locking.

The above object is achieved according to the present invention by a submunition unit for a spin stabilized carrier projectile, which submunition comprises an outer casing having a first axially extending annular collar at its front end; an antenna mounted in the casing at the front end; a protective cover for the antenna, with the cover having a second axially extending annular collar at its rear end, with the first and second collars axially overlapping and engaging one another, and with a radially extending end surface of at least one of the collars engaging a radially extending surface associated with the other of the collars to axially support the cover on the casing; and means for securing the protective cover to the casing including a locking element mounted for movement in a direction toward the circumference of the casing to form a form-locking connection between the cover and the casing in response to an appropriate centrifugal force and to release the connection between the cover and casing when the number of revolutions of the unit, and thus the centrifugal force, drops below a given value; and wherein the locking element is a securing ring which expands under the influence of centrifugal forces, and the securing means further comprises: a first circumferential groove on an exterior surface of the radially inward one of the first and second collars, with the first circumferential groove having a depth corresponding to the thickness of the securing ring in the radial direction and normally containing the securing ring; and a second circumferential groove formed on an interior surface of the radially outer one of the first and second collars opposite the first circumferential groove, with the second circumferential groove having a depth less than the thickness of the securing ring, and with both of the grooves having an axial height which includes an amount of play relative to the axial height of the securing ring that is greater than the axial deformation caused by the deformation forces generated at the first and second collars during launching of the unit.

The connection between the casing of the submunition and its protective cover is here produced by an axial overlap, of these members either on the interior or exterior of the casing, in whose region a circumferential groove is arranged in both components, with the two grooves facing one another and accommodating a securing ring which is elastically deformed under centrifugal forces. The diameter of this securing ring is determined by the active centrifugal force and the inherent tension of the ring so that, under the appropriate centrifugal force, it is seated in both grooves and thus connects the two components together. Thus, only one securing element is required with lower tolerance requirements and greater operational reliability, without it being necessary to make significant structural changes in existing projectile components.

Slotted steel rings, slotted or non-slotted plastic rings, rubber rings, 0-rings, a coil spring closed into a ring, or the like can be employed as securing rings. The securing rings may have a rectangular, circular or similar cross section. If the cross section is circular, a depth of at least somewhat more than the radius of the cross section should be selected for the radially outer groove.

In particular, the securing ring is given such dimensions that the form-locking connection between casing and protective cover is released at a predetermined number of revolutions of about 10 Hz.

Advisably the collars are given rounded, for example chamfered, edges at their mutually facing sides.

The invention will be described below in greater detail with reference to embodiments thereof that are illustrated in the attached drawings.

BRIEF DESCRIPTION OF THE DRAWINGS

FIG. 1 is a schematic representation of a spin stabilized carrier projectile provided with submunition units.

FIG. 2 is a partial sectional view of one embodiment of a submunition unit according to the invention.

FIGS. 3 and 4 are partial sectional views of further embodiments, according to the invention, of submunition units that are modified somewhat compared to the unit of FIG. 2.

FIG. 5 is a longitudinal sectional view of a special modification of the lock in the operating state.

FIGS. 6 and 6*a* show a sectional front and side view of a slotted locking element made of steel.

DETAILED DESCRIPTION OF THE PREFERRED EMBODIMENTS

Referring now to FIG. 1, there is shown a spin stabilized carrier projectile 1 composed of a casing 2 which accommodates two submunition units 3, 3'. In a conventional manner, each submunition unit 3, 3' contains a parachute arrangement 4, composed of a deceleration parachute and a main parachute, in its tail. At its nose, each submunition unit 3, 3' is provided with an antenna 5 which is covered by a protective cover 6 as can best be seen in FIG. 2. The protective cover 6 serves, in particular, to protect the antenna 5 of the submunition unit 3' in the tail of the carrier projectile 1 against the parachute arrangement 4 of the submunition unit 3 in the nose of the carrier projectile from the moment of launching of the carrier projectile 1 until some time after the submunition units 3, 3' are released or ejected from carrier projectile 1.

According to FIG. 2, the casing 7 of submunition unit 3 (or 3') is provided at its front end facing protective cover 6 with an axially extending circumferential collar 8. This collar 8 is axially overlapped on its exterior circumference by an axially extending circumferential collar 9 provided at the rear of protective cover 6. The protective cover 6 is supported axially at a forward end face 10 of casing 7, and, if required, additionally at a further radially extending forward facing face 11 of casing 7, via end faces 12 and 13 respectively of the protective cover 6. The exterior edge 20 and the interior edge 21 of end surface 10 and 13 respectively are chamfered or rounded in order to support release of protective cover 6 in the axial direction without canting.

The collar 8 is provided with a circumferential groove 14 in its outer circumferential surface and the cover 6 is provided with a circumferential groove 15 in its inner surface. The two grooves 14 and 15 are disposed opposite one another so that together they form an annular recess, which has a rectangular cross section in the illustrated embodiment, extending between the protective cover 6 and the casing 7. The groove 14 of collar 8, which is open toward the circumference of the casing 7, has a depth that corresponds to the radial thickness of a securing ring 16 disposed in groove 14, but may be somewhat deeper. However, the radially inwardly open groove 15 of collar 9 has a depth which is less than the radial thickness of the securing ring 16, for example, about half as deep as this radial thickness. Both grooves 14 and 15 have a height in the axial direction of submunition unit 3 that exceeds the axial height of securing ring 16 at least by an amount of play 17 that corresponds to the axial deformation generated in the region of collars 8 and 9 by deformation forces during launching of carrier projectile 1 so that securing ring 16 will not be clamped in by this axle deformation.

Upon launching of the spin stabilized carrier projectile 1, the then generated centrifugal force causes securing ring 16 to expand relative to its inherent tension and thus partially come out of groove 14 and enter into groove 15 to thus connect protective cover 6 with casing 7 in a form-locking manner. After release of submunition unit 3 from carrier projectile 1, the deceleration parachute of parachute arrangement 4 is deployed first, thus reducing the spin of submunition unit 3 so that, once a certain number of revolutions of, for example, 10 Hz has been reached, the inherent tension in securing ring 16 and the greatly reduced influence of centrifugal forces cause securing ring 16 to be again completely accommodated in groove 14 so that the form-locking connection between protective cover 6 and casing 7 is released. Thereafter, deployment of the main parachute causes protective cover 6 to be separated from casing 7 due to inertial forces and thus release antenna 5 which until then has been protected by protective cover 6. Separation of the protective cover 6 prevents damage to antenna 5.

In the embodiment shown in FIG. 3, casing 7 is provided with an inserted collar 8' which simultaneously serves as a holding ring and which axially passes over and overlaps the outer circumference of collar 9' on the protective cover 6'. In comparison to the depth of groove 15', the groove 14' of collar 8 has a much smaller depth which, however, is sufficient to produce the desired form-locking connection under the influence of spin.

According to FIG. 4, a securing ring 16' is provided which has a round cross section, for example, a coil spring that is closed into a ring or the like. Here the depth of the radially outer groove 15" is somewhat greater than half the radial thickness of securing ring 16' so that a secure form-locking connection can be obtained under the influence of centrifugal forces. Additionally, grooves 14" and 15" may here have an essentially semicircular bottom as shown.

As shown in FIG. 3, the transfer of torque between submunition unit 3 and protective cover 6' during the spin reduction phase after release of submunition unit 3 from carrier projectile 1 can be effected by one or a plurality of axially extending pins 18 provided at the frontal or end surface of protective cover 6. These pins are received by corresponding bores 19 in the end face of casing 7 and remain in the protective cover 6 when the latter is separated.

The securing ring 16 or 16' may have a rectangular cross section as shown in FIGS. 2 and 3 or a circular cross-section as shown in FIG. 4, and may be formed of various materials and provided with various configurations to provide the desired and necessary elasticity or expandability. For example, the securing ring may be a slotted steel ring, a slotted or unslotted ring formed of plastic or rubber, or as indicated above, a coil spring which as been closed into a ring.

The embodiment illustrated in FIG. 5 shows a slotted steel ring 16 which is shown in FIGS. 6 and 6*a* and which, at an operating rotational speed of approximately 10 Hz of the carrier projectile 1, functions as a slotted locking element and produces a form-locking connection between the protective cover 6' and the casing 7. The locking element comprises a steel ring 16 provided with a radial slot 22 and having a thickness t of 0.9 mm, a width w of 3.4 mm, an inner diameter d of 121.5 mm, and thus an outer diameter of 128.3 mm. The locking element or ring 16, in the illustrated embodiment, forms a form-locking connection between the protective cover 6' and the holding ring 8' fastened to the casing 7. The groove 15', in which the ring 16 is located when in an unlocked position, and the groove 14', into which the ring 16 extends when in a locking position, each have a height h of 1 mm. The interior surface of the groove 15' has a diameter d1 of 123.6 mm, the outer end of groove 15' and of groove 14' is at a diameter d2 of 131 mm, and the interior surface of groove 14' has a diameter d3 of 132.4 mm. With these dimensions, the ring 16 will extend into the groove 14' to form a form-locking connection with a depth of engagement of 0.7 mm corresponding to one half of the difference in diameter between diameters d3 and d2, i.e., 132.4–131 mm. In the unlocked state, i.e., when the steel ring 16 is totally within the groove 15', the steel ring 16 contacts the interior surface of groove 15', i.e., the surface with the diameter d1 of 123.6 mm.

The invention now being fully described, it will be apparent to one of ordinary skill in the art that any changes and modifications can be made thereto without departing from the spirit or scope of the invention as set forth herein.

What is claimed is:

1. In a submunition unit for a spin stabilized carrier projectile comprising:

an outer casing having a first axially extending annular collar at its front end; an antenna mounted in said casing at said front end; a protective cover for said antenna, said cover having a second axially extending annular collar at its rear end, with said first and second collars axially overlapping and engaging one another and with a radially extending end surface of at least one of said collars engaging a radially extending surface associated with the other of said collars to axially support said cover on said casing; and means for securing said protective cover to said casing including a locking element mounted for movement in a direction toward the circumference of said casing to form a form-locking connection between said cover and said casing in response to an appropriate centrifugal force acting on said unit and to release the connection between said cover and said casing when the number of revolutions of said unit, and thus the centrifugal force, drops below a given value; the improvement wherein said locking element is a securing ring which expands under the influence of centrifugal forces, and said means further comprises: a first circumferential groove on an exterior surface of the radially inward one of said first and second collars, said first circumferential groove having a depth corresponding to the thickness of said securing ring in the radial direction and normally containing said securing ring; and a second circumferential groove formed on an interior surface of the radially outer one of said first and second collars opposite said first circumferential groove, with said second circumferential groove having a depth less than said thickness of said securing ring, and both of said grooves having an axial height which includes an amount of play relative to the axial height of said securing ring that is greater than the axial deformation caused by the deformation forces generated at said first and second collars during launching of said unit.

2. A submunition unit as defined in claim 1, wherein said securing ring is a slotted steel ring.

3. A submunition unit as defined in claim 1, wherein said securing ring is a slotted ring formed of one of plastic and rubber.

4. A submunition unit as defined in claim 1 wherein said securing ring is an unslotted ring formed of one of plastic and rubber.

5. A submunition unit as defined in claim 1, wherein said securing ring is a coil spring which has been closed into a ring.

6. A submunition unit as defined in claim 1, wherein said securing ring has a rectangular cross section.

7. A submunition unit as defined in claim 1, wherein said securing ring has a round cross section.

8. A submunition unit as defined in claim 1, wherein said securing ring has dimensions such that the form-locking connection between said casing and said protective cover is released at a predetermined number of revolutions of about 10 Hz.

9. A submunition unit as defined in claim 1, further comprising means for providing a torque transferring engagement between said casing and said protective cover.

10. A submunition unit as defined in claim 9, wherein said means for providing a torque transferring engagement includes at least one axial extending pin disposed between said casing and said protective cover.

11. A submunition unit as defined in claim 1, wherein said first and second collars have rounded corners at their mutually facing side edges.

* * * * *